US011749120B2

(12) United States Patent
Luebke et al.

(10) Patent No.: US 11,749,120 B2
(45) Date of Patent: Sep. 5, 2023

(54) DRONE DETECTION DEVICE AND RELATED METHOD

(71) Applicant: Terra Vigilis, Inc., Hartland, WI (US)

(72) Inventors: Charles John Luebke, Hartland, WI (US); Timothy Edward Tyre, Hartland, WI (US)

(73) Assignee: Terra Vigilis, Inc., Hartland, WI (US)

( * ) Notice: Subject to any disclaimer, the term of this patent is extended or adjusted under 35 U.S.C. 154(b) by 12 days.

(21) Appl. No.: 17/524,494

(22) Filed: Nov. 11, 2021

(65) Prior Publication Data

US 2022/0165165 A1 May 26, 2022

Related U.S. Application Data

(60) Provisional application No. 63/117,572, filed on Nov. 24, 2020.

(51) Int. Cl.
*G08G 5/00* (2006.01)

(52) U.S. Cl.
CPC ..... *G08G 5/0026* (2013.01)

(58) Field of Classification Search
CPC ..... G08G 5/0026
See application file for complete search history.

(56) References Cited

U.S. PATENT DOCUMENTS 10,825,345 B2 * 11/2020 Sugahara ..... H04W 4/40
2018/0240330 A1 * 8/2018 Choi ..... G08G 5/0082

FOREIGN PATENT DOCUMENTS

CN 111628843 A * 9/2020
WO WO-2019032162 A2 * 2/2019 ..... G06F 21/44

* cited by examiner

*Primary Examiner* — Curtis A Kuntz
*Assistant Examiner* — James E Munion
(74) *Attorney, Agent, or Firm* — Jansson Munger McKinley & Kirby Ltd.

(57) ABSTRACT

A drone detection apparatus and method for same, that provides a real time solution for detecting drones and informing and alerting a user. The apparatus includes a housing with a processor and memory, at least one indicator, at least one switch, a connector, a radio, an antenna and a power source; and a housing-carrier in which the housing is removably secured. When a drone transmits an identification broadcast message the processor has the ability to receive and recognize the identification broadcast message. The apparatus can receive a remote identification message intermittently broadcast from a drone and can send, forward and receive alerts to and from one or more remote devices.

16 Claims, 7 Drawing Sheets

INITIALIZE: SoC, TIMER, RADIO, INDICATORS, ECT.

IF POWER ON SELF TEST (POST) PASSES,

THEN: TURN ON GREEN / BLUE LED [STATUS = operational] AND

DO:

IF UAS REMOTE ID MESSAGE RECEIVED,

THEN: TURN OFF GREEN / BLUE LED INDICATOR AND TURN ON ALERT INDICATORS [Red LED], RESET TIMER.

IF UAS REMOTE ID MESSAGE NOT RECEIVED AND TIMER = 15 SEC,

THEN: TURN ON GREEN / BLUE LED INDICATOR, TURN OFF ALERT INDICATORS [Red LED].

WHILE;

ELSE: [POST fails] FLASH GREEN / BLUE LED [STATUS = nonoperational]

ADDITIONAL STEP COULD BE ADDED TO MAKE THE INDICATORS [Red LED] HAVE FLASH RATE PROPORTIONAL TO THE RSSI OF A RECEIVED UAS REMOTE ID MESSAGE.

FIG. 3

DRONE DETECTION DEVICE AND RELATED METHOD

RELATED APPLICATION

This application claims the benefit of provisional application Ser. No. 63/117,572, filed on Nov. 24, 2020, the entire contents of which are incorporated herein.

FIELD OF THE INVENTION

This invention relates to apparatuses for detection, and more particularly, to an apparatus and method for detection of unmanned aerial drones.

BACKGROUND OF THE INVENTION

Individuals, businesses and government entities within our society are interested in maintaining their privacy rights, whether on privately-owned property or in public spaces. With the proliferation of drones being flown in neighborhoods, parks, public venues, etc., individuals are interested in knowing when one or several unmanned aerial drones (referred to herein as a "drone") are in the near proximity. Individuals are interested in a simple, low cost apparatus and method by which to be immediately alerted when a drone is in proximity to their location. This provides for the ability of the individual to seek shelter within a building, under a roof or tree, or within a vehicle if they so choose. Such action could be predicated on various reasons, including but not limited to the preference to not be photographed or videoed by a drone with a camera. In other cases, it enables an individual to contact authorities or even to access a Remote ID USS (Unmanned Service Suppliers) to identify the remote pilot of the drone. Such action can lead to follow up education or enforcement by authorities.

Early detection of a drone entering, staying or landing within an alert zone may also be important to notify security personnel of the presence of a drone, so they can physically investigate to determine if the drone, and any associated payload, might contain surveillance or snooping equipment (such as, cameras, wireless "sniffing" receivers, etc.), contraband, explosives, incendiary devices, or other biochemical agents. Drones are governed by the Federal Aviation Administration ("FAA") which is the rulemaking body for USS Remote ID.

One such detection method in the prior art is disclosed in U.S. Pat. No. 10,825,345 to Sugahara which uses an electronic beacon system. Drone detection methods and devices of the prior art typically have certain disadvantages. The majority of devices are not reliable as to detection or identification techniques and are also expensive to manufacture. It would be advantageous to have a drone detection device and related method which is able to reliably inform individuals of the presence in real time of a drone in their proximity and also which is simple and cost-effective to manufacture. Another advantage would be to have a drone detection device which is a standalone, self-contained device and which can be worn or carried by a user.

In summary there are problems and shortcomings in the relevant prior art and it is to these needs that this device is drawn.

SUMMARY OF THE INVENTION

This application discloses an inventive apparatus and method for detecting drones. The apparatus includes a housing with a processor, at least one indicator, at least one switch, a radio, an antenna and a power source and a housing-carrier in which the housing is removably secured. Preferably, when a drone transmits an identification broadcast message the processor has the ability to receive and recognize the identification broadcast message.

It is highly preferable that the housing includes a System on Chip (also referred to as "SOC") which has the processor and memory. Preferably, the memory can record and store remote identification messages from a drone for future reference by a user. The System on Chip can receive a remote identification message intermittently broadcast from a drone and can send, forward and receive alerts to and from one or more remote devices. It is also preferable that the housing includes a connector.

Preferred embodiments include that once the processor has recognized the remote identification message the at least one indicator can alert a user as to the presence of a drone. The at least one indicator can be a visual indicator including one or more lights or can be an audible indicator including a tone, chirp or other sound in preferred embodiments. It is also preferable that the radio has WiFi® and Bluetooth® capabilities.

In some embodiments the housing-carrier can be attached to, hung on or mounted to an object or the housing-carrier can incorporated into a watch, jewelry, USB dongle or a compass.

The visual indicator can be one or more lights in various colors or can be a flashing light with a rate proportional to receive signal strength indication from the drone and the audible indicator can be one or more sounds with a rate proportional to receive signal strength indication from the drone in highly-preferred embodiments. The audible indicator can include a mute switch. It is preferable that the visual indicator or the audible indicator turns on to indicate receiving a remote identification message from a drone and turns off after a selected time period when the remote identification message is no longer received, both the visual indicator and the audible indicator are able to be adjusted. In some preferred embodiments the visual indicator is an LED with a translucent lens.

A preferred method for detecting and alerting a user to the presence of a drone, includes the steps of providing a housing having a processor, at least one indicator, at least one switch, a connector, a radio, an antenna and a power source; and a housing-carrier in which the housing is removably secured; receiving and recognizing a remote identification message transmitted from a drone; and alerting a user to the presence of a drone by turning on the at least one indicator, the at least one indicator being visual, audible or a vibration.

BRIEF DESCRIPTION OF THE DRAWINGS

The drawings illustrate preferred embodiments including the above-noted characteristics and features of the device. The device will be readily understood from the descriptions and drawings. In the drawings:

FIG. 3 is a flowchart of the apparatus for detecting drones program of FIG. 1;

DETAILED DESCRIPTION OF EMBODIMENTS

A preferred embodiment of the invention is shown in FIGS. 1-8. While the solution described in the following text and the accompanying figures largely focuses on examples of improvements for a device which can detect and alert a user to a drone for use by individuals, those in the field will recognize that such a device can be used in other applications. The drone detection device described herein can also be useful for commercial or private entities that are interested in one or more simple drone alert devices for specific locations and/or events.

FIGS. 1-8 illustrate example embodiments which are directed to solutions and methods for an improved drone detection apparatus and related method. Example embodiments are described herein with reference to the accompanying drawings, however, these example embodiments are not limiting and those skilled in the art will appreciate that various modification are within the scope of this disclosure. Example embodiments can be used with the drone detection device for any of a number of other applications and locations, including but not limited to parks, beaches, stadiums, public venues, outdoor concerts or events.

A low-cost System on Chip with WiFi®/Bluetooth® radio that receives the mandated USS Remote ID message broadcast over WiFi® and Bluetooth® communications bands (2.4 GHz) and utilizes a visual and/or audible and/or vibration output for informing the user of the presence of a drone is disclosed. Alternate embodiments of the drone detection device are packaged in different/various forms to facilitate having the device be wearable, mountable, hangable, pluggable, fashionable, etc. A related method is described which provides a drone detection device on or near an individual. The device contains a SOC with WiFi®/Bluetooth® radio, that performs an ongoing autonomous detection for any UAS Remote ID messages broadcast by one or more drones and provides a visual and/or audible and/or vibration alert. The system scales to provide larger areas of detection coverage with the use of multiple devices at different locations (for example, a perimeter).

Figure 1:
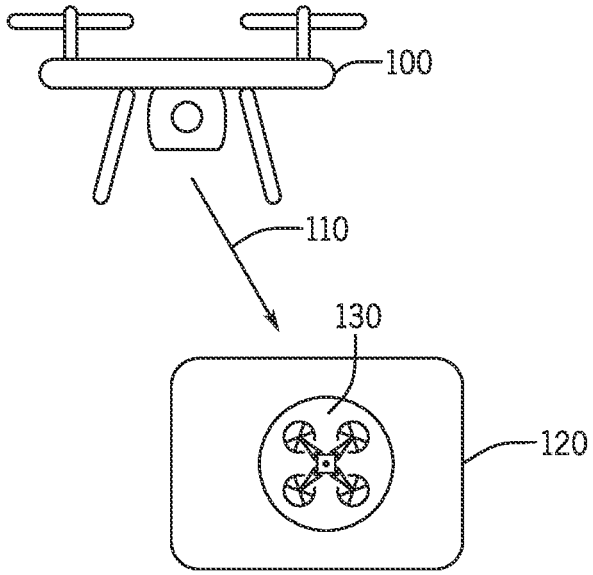
FIG. 1 is a perspective view of the apparatus for detecting drones in an example environment with a drone.

FIG. 1 illustrates a standalone device (also referred to as "drone detecting device" or "housing") 120 within the overall environment. The FAA rulemaking for UAS Remote ID message broadcast requires that a drone 100 with Standard Remote ID capabilities transmits a unique UAS Remote ID message 110 periodically (typically 1 message per second) whenever the drone is powered up. This enables other devices within range to receive the periodically transmitted UAS Remote ID messages. Drone detecting device 120 has a simple message filter to receive and recognize valid UAS Remote ID messages 110, and when a message 110 is received (detected), drone detecting device 120 turns on an indicator 130 (which can be visual, audible, vibration, etc.) to alert the user of the presence of drone 100 in proximity to drone detecting device 120. Drone detecting device 120 does not need to fully decode the message, as the reception and detection of UAS Remote ID message 110 is sufficient to indicate an alert.

Figure 2:
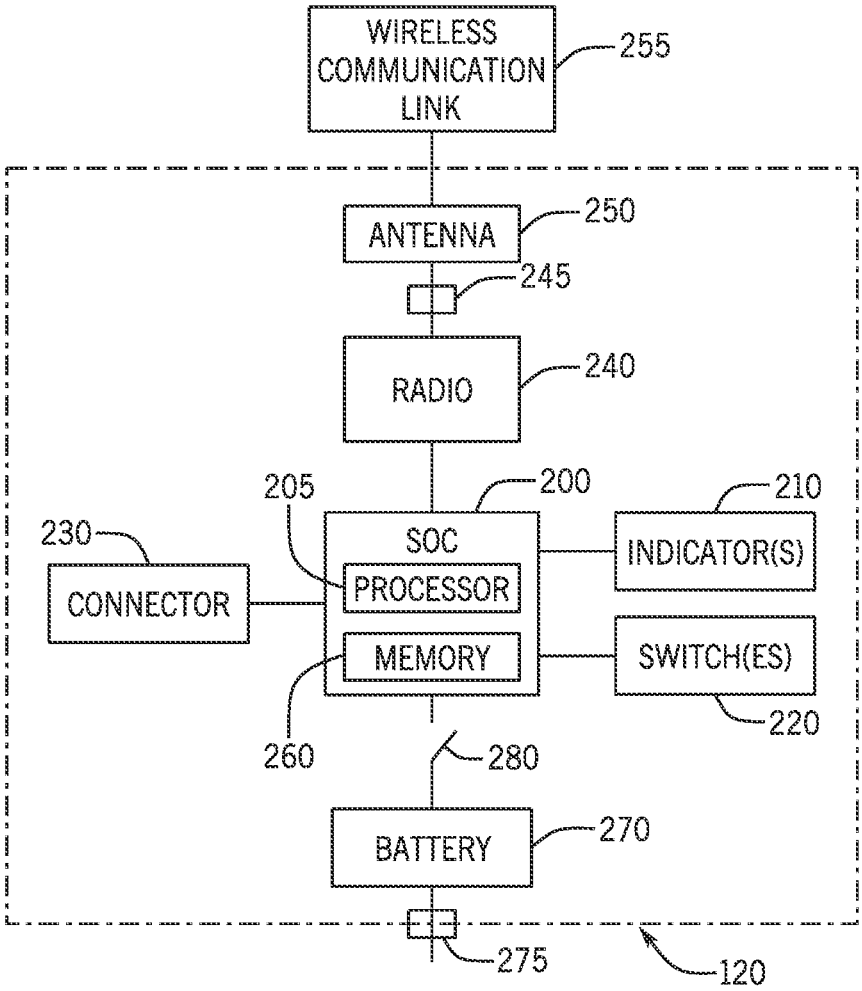
FIG. 2 is a block diagram of the apparatus for detecting drones of FIG. 1.

FIG. 2 is a block diagram of the drone detecting device 120. As seen in FIG. 2, drone detecting device 120 has a System on Chip (SOC) 200 with a 2.4 GHz radio 240 and internal antenna(s) 250 to receive UAS remote ID messages 110 which are broadcast (transmitted) from drone 100 as a WiFi® or Bluetooth® packet. SOC 200 processes received WiFi® and Bluetooth® packets to simply recognize receipt of a valid UAS Remote ID broadcast message 110, and to take one or more actions including to turn on an indicator 210 (visual and/or audible and/or vibration) to alert user of the presence of drone 100 in proximity to the drone detecting device 120. SOC 200 within drone detecting device 120 has a processor 205 with an associated program that will execute a series of commands/instructions to perform each of these functions.

FIG. 2 illustrates that drone detecting device 120 has a visual indicator 210 that can turn on and off one or more colored LEDs to indicate status and/or alert (drone detected). Drone detecting device 120 has an optional audible sound generator for indicating alert of drone 100 nearby. Drone detecting device 120 may also have an optional vibration sensor to discreetly inform the user. Drone detecting device 120 may also have optional mute/silent/acknowledge switch 220.

Threat/Risk assessments may be based on critical parameters including Receive Signal Strength Indicator (RSSI). For example, based on the RSSI associated with receiving a UAS Remote ID message, the higher the signal strength the closer the drone is presumably to drone detecting device 120. Based on RSSI, the flash rate of the indicator 130, 210 (visual and/or audible and/or vibration) could be increased for a higher RSSI to indicate that drone 100 is approaching. Conversely, if the RSSI signal is getting weaker, the flash rate of indicator 130, 210 could be decreased to indicate that drone 100 is moving away from drone detecting device 120. Indicator 130, 210 should remain on for a given period (ex. 15 seconds) after UAS Remote ID message 110 is no longer received so that if it is a result of a temporary loss of receiving UAS Remote ID message 110 (due to a signal being blocked by an obstruction) drone detecting device 120 will not have indicator(s) 130, 210 turn on/off erratically. A threshold could also be adjusted and set for when the alert indicator is to be turned on based on the RSSI level. This enables reduction of alerts from drones farther away, and only indicating drones at closer range. The threshold could be adjusted and set by holding the switch a 220 for an extended period, versus a short tap to just acknowledge (or mute) indicator 130, 210.

As seen in FIG. 2, drone detecting device 120 preferably has one or more internal antenna(s) 250 to enhance detection range (planar, chip, MIMO, etc.). An optional connector 245 enables connection of one or more external antennas to further increase sensitivity and range.

A battery 270 is preferably internal to drone detecting device 120 and can be a coin cell battery, AAA batteries or a rechargeable battery, etc. An optional external power connector 275 (USB, pin jack, etc.) can be used for recharging the internal battery, enable a larger external battery for extended use, or to connect an external power source. An optional power switch 280 in series with the internal battery is used to reduce power consumption and extend operational availability. Alternatively, battery 270 can be external to drone detecting device 120.

FIG. 2 also illustrates that drone detecting device 120 may have one or more connectors 230 (an example is a USB port) and/or wireless communication links 255 to connect to another device for communicating alerts, and/or to provide for configurable settings or programmable upgrades to be stored in memory 260. For example, one or more configurable/customizable threat/risk assessments based on key parameters can be set for the specific application or operating site/venue/event. Drone detecting device 120 may also receive configuration input to identify authorized drones that can be whitelisted. For example, a drone operator wants an alert only when a drone besides their own enters the area, or to whitelist drones performing authorized commercial operations (delivery, mapping, etc.). Indicator 210 can be white (instead of red in color) to indicate that the detected drone is whitelisted.

Drone detecting device 120 may contain memory 260 to log Remote ID messages 110 that can be downloaded via a wired or wireless communication link to another device for further decoding, analysis, and/or USS lookup to determine additional information regarding the drone alert. (For example, the specific drone ID, pilot ID and/or location and tracking information.)

Drone detecting device 120 may also include a watch-type display function so that when used as a wrist bracelet a separate watch for keeping track of time is not required to be worn. Drone detecting device 120 may also include a digital or analog compass so that a user can also determine a bearing of the drone if sighted, and be able to report to law enforcement what direction the drone came from or departed to.

FIG. 3 is a self-explanatory flowchart of drone detecting device 120 program. An additional step in the flowchart can be added to make the alert indicator [red LED] have a flash rate proportional to the RSSI of a received UAS Remote ID message 110. Another additional step could be added to make the alert indicator white when a whitelisted drone is present and a non-whitelisted drone is not present (i.e., unauthorized drone [red] takes precedence over whitelisted drone [white]).

Figure 4A:
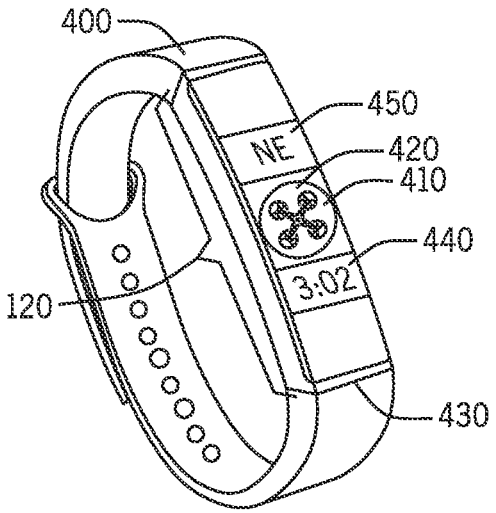
FIG. 4A is a perspective view of a wearable embodiment of the apparatus for detecting drones.
Figure 4B:
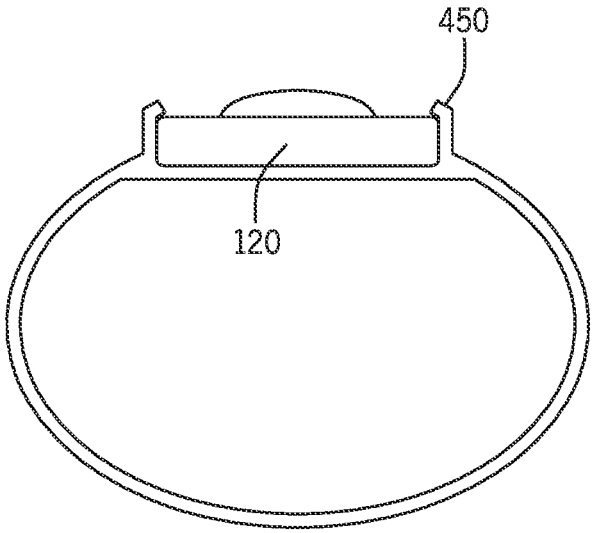
FIG. 4B is a side view of the wearable embodiment of the apparatus for detecting drones of FIG. 4A.

FIGS. 4A-4B are embodiment of drone detecting device 120 as a wrist bracelet 400. Drone detecting device 120 in this embodiment contains indicator 410 for indicating the presence of a drone using an LED to illuminate a translucent lens that has a drone symbol (a quad copter inside a circle is often used as a drone symbol and this will be used as the example herein) screened/embossed onto it. Drone detection can also be indicated with an audible alert and/or vibration (not shown). An optional switch 420 is used to acknowledge the alert, which can be used to turn off or mute the indicator until the next time a new UAS Remote ID message 110 is received (after the timeout period). An optional connector 430 can be used to perform one or more of the following functions: power to recharge battery, configure drone detecting device 120, reprogram drone detecting device 120, and retrieve a data log of UAS Remote ID messages 110 received. Wrist bracelet 400 can be designed and molded of pliable rubber/plastic that forms a lip 450 over the edge of drone detecting device 120 to serve as a retention device. Drone detecting device 120 may directly incorporate a watch display function 440 and/or compass 450. Alternatively, wrist bracelet 400 may incorporate integrate a separate watch display 440 and/or compass 450.

Figure 5:
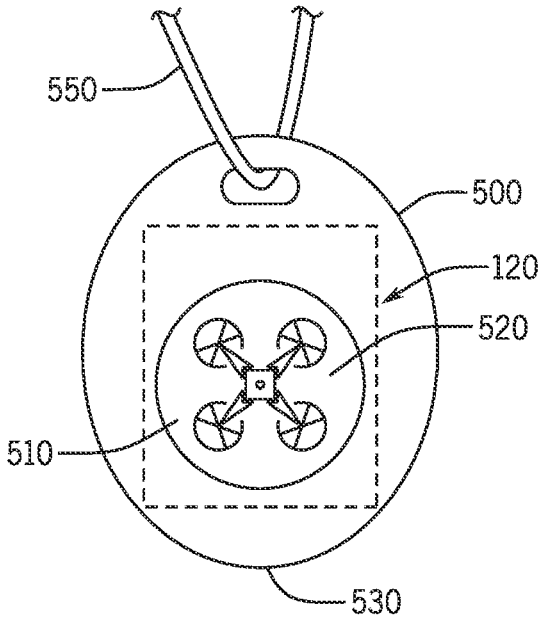
FIG. 5 is a perspective view of an alternative wearable embodiment of the apparatus for detecting drones.

FIG. 5 illustrates an alternate embodiment of drone detecting device 120 as a pendant 500. Drone detecting device 120 can be attached to a necklace, lanyard, ring, clip, carabiner, 550 among other things and hung from around the neck, pinned on a lapel, clipped onto a belt, strap, key fob, etc. An indicator 510 can be integrated with an illuminated switch 520 to directly acknowledge (or mute) the alert. A connector 530 can be recessed under a small cover (not shown).

Figure 6:
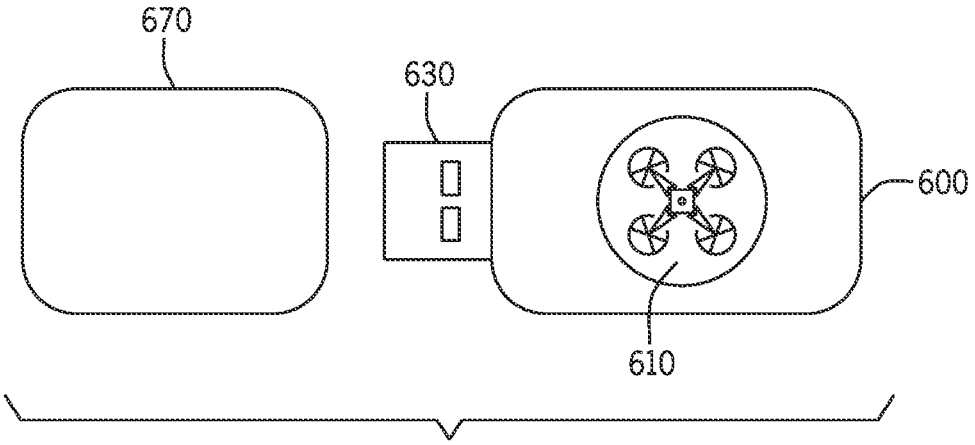
FIG. 6 is a perspective view of an alternative embodiment of the apparatus for detecting drones with a battery pack.

FIG. 6 is another alternate embodiment of drone detecting device 120 as a USB dongle 600. Drone detecting device 120 in this embodiment includes a USB port 630 (port can be a micro, mini, Type A, Type C, etc.) for power, communications, configuration, and download of alert log. An indicator 610 can be integral to the translucent USB dongle housing-carrier. Drone detecting device 120 as a USB dongle 600 can be mated with a small battery pack 670 to provide a complete self-powered mobile unit.

Figure 7A:
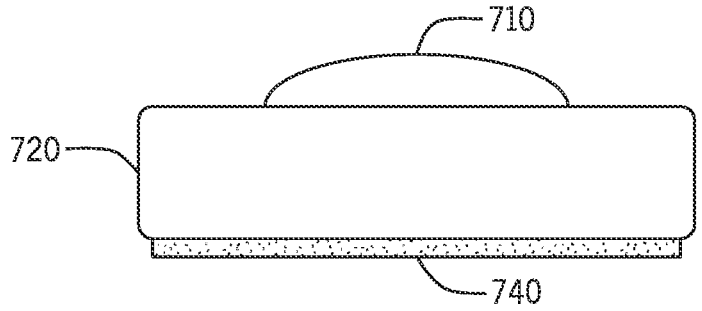
FIG. 7A is a side view of another alternative embodiment of the apparatus for detecting drones.
Figure 7B:
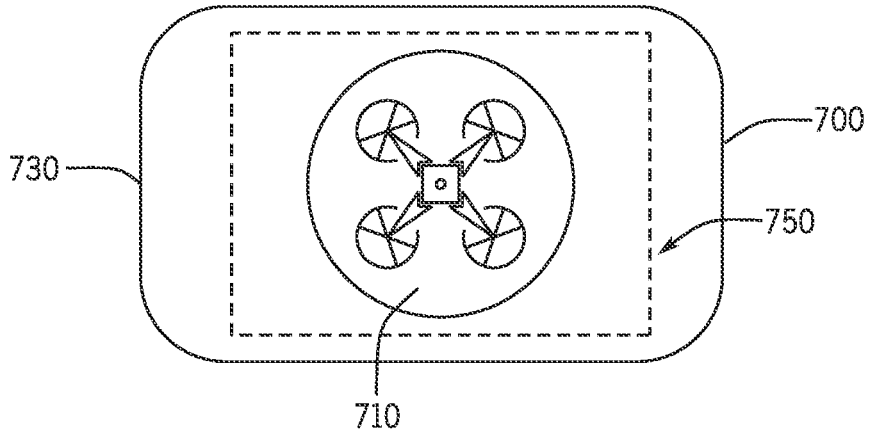
FIG. 7B is a front view of the alternative embodiment of FIG. 7A.

FIGS. 7A-7B illustrate another alternate embodiment of drone detecting device 120 as a standalone/mountable device 700. A switch 720 can be located on the top or side of drone detecting device 120, or switch 720 can be integral to an illuminated indicator 710. Indicator 710 can be located on the top of drone detecting device 120, or indicator 710 can be integral to and illuminate the whole translucent drone detecting device 120 housing. An optional connector 730 can be used to perform one or more of the following functions: power to recharge battery, configure drone detecting device 120, reprogram drone detecting device 120, and retrieve a data log of UAS Remote ID messages 110 received.

FIG. 7A illustrates that an adhering surface 740 can be made of any suitable material such as double sided tape, a rubber magnet, VELCRO®, a suction cup, etc. The shape of the internal electronics Printed Circuit Board ("PCB") 750 can be designed so that it can be used in both the rectangular standalone housing-carrier 700 or pendant shaped housing-carrier 500. The shape and packaging of internal electronics PCB 750 could be further designed to serve as USB dongle 600 with an internal (female) connector versus an external (male) connector. The shape of drone detecting device 120 as standalone/mountable device 700 could be further designed and packaged so that it can be snapped into or retained by pendant 500 or wrist bracelet 400. This facilitates wearing of drone detecting device 120 for mobile use, and removal of drone detecting device 120 from wrist bracelet 400 for stationary use (standalone, USB dongle, etc.).

Figure 8:
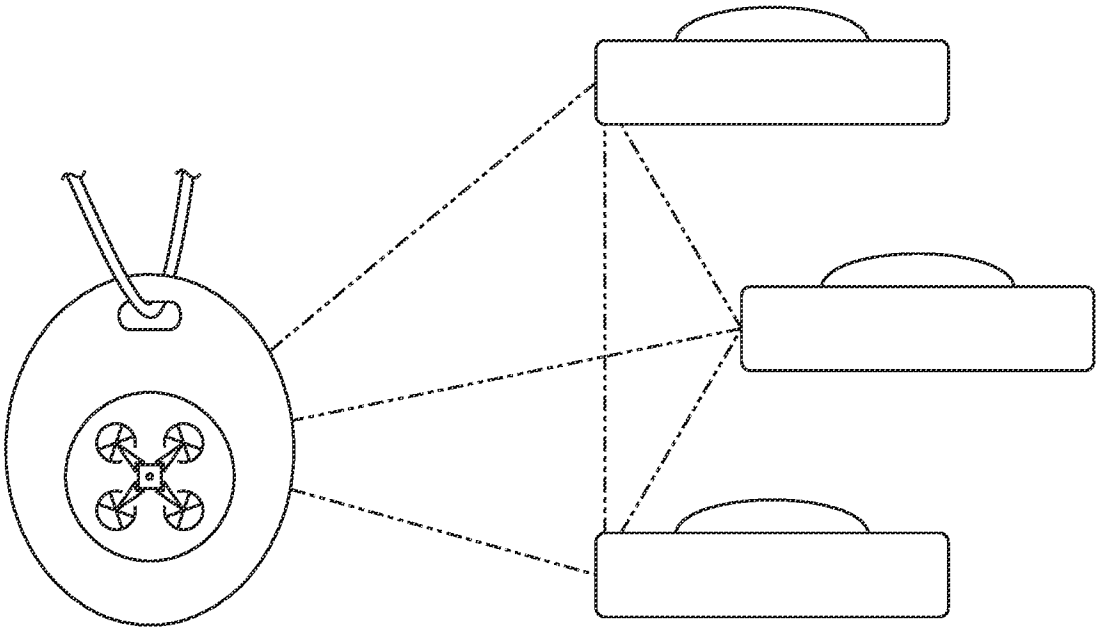
FIG. 8 is a perspective view of a networked apparatus for detecting drones.

FIG. 8 illustrates an example of multiple networked drone detecting devices 120 (in a pendant shaped housing-carrier 500) to provide a larger detection area. Multiple independent drone detecting devices 120 can simply be placed at different locations around an area (or perimeter). If mounted on tables, walls, pedestals, etc., or hung from various visible objects, the user (or anyone in the vicinity) can visually scan to see if any of drone detecting devices 120 visual alert indicators are red in color or flashing, or a user could listen for an audible alert from one or more of drone detecting devices 120. An enhanced version would enable drone detecting devices 120 that are configured or auto-discovered, to be interconnected in a wireless mesh network so that if any one of drone detecting devices 120 detected a drone, all drone detecting devices 120 within that network would communicate and indicate an alert.

FIGS. 4-8 illustrate that drone detecting device 120 is a housing and that drone detecting device 120 can be removable secured into various housing-carriers as noted herein. Housing carriers can include, but are not limited to, bracelet 400, pendant 500, USB dongle 600 and mountable/standalone device 700. Suitable housing-carriers can be any shape in which drone detecting device 120 can be removably secured. Housing-carriers can be attached to, hung on or mounted to an object or the housing-carrier can incorporated into a watch, jewelry, USB dongle or a compass as noted herein.

A related method for detecting and alerting a user to the presence of a drone is also disclosed herein. The related method includes the steps of providing a housing having a processor, at least one indicator, at least one switch, a connector, a radio, an antenna and a power source; and a housing-carrier in which the housing is removably secured; receiving and recognizing a remote identification message transmitted from a drone; and alerting a user to the presence of a drone by turning on the at least one indicator, the at least one indicator being visual, audible or a vibration.

Although the device is described with reference to example embodiments, it should be appreciated by those skilled in the art that various modifications are well within the scope of the invention. From the foregoing, it will be appreciated that an embodiment of the present invention overcomes the limitations of the prior art. Those skilled in the art will appreciate that the present invention is not limited to any specifically discussed application and that the embodiments described herein are illustrative and not restrictive. From the description of the example embodiments, equivalents of the elements shown therein will suggest themselves to those skilled in the art, and ways of constructing other embodiments of the present invention will suggest themselves to practitioners of the art. Therefore, the scope of the present invention is not limited herein.

The drawings illustrate only example embodiments of the invention and are therefore not to be considered limiting in scope, as the invention includes other equally effective embodiments. The elements and features shown in the drawings are not necessarily to scale, emphasis instead is placed upon clearly illustrating principles of the example embodiments. Additionally, certain dimensions or positionings may be exaggerated to help visually convey such principles.

It should be noted that the terms "UAV," "drone" and "unmanned aerial drone" are used interchangeably throughout this application. "UAV" refers to and means an unmanned aerial vehicle.

The term "payload capacity" as used herein means the gross load weight the drone is capable of safely carrying.

The term "Bluetooth®" as used herein means the technology that enables exchange of data between devices within a short amount of distance.

The term "SOC," and "System on Chip" are used interchangeably through this application and as used herein mean an integrated circuit that takes a single platform and integrates an entire electronic or computer system into it.

The term "dongle" as used herein means a piece of computer hardware that connects to a port on another device to provide it with additional functionality, or enable a pass-through to such a device that adds functionality.

The term "remote device" or "remote devices" as used herein means and refers to another drone detecting apparatus, a mobile phone, laptop computer, tablet and/or other display device.

The invention claimed is:

1. An apparatus for detecting drones comprising:

a housing having a processor, at least one indicator, at least one switch, a radio, an antenna and a power source; and a housing-carrier in which the housing is removably secured, wherein when a drone transmits an identification broadcast message the processor has a simple message filter with the ability to receive and recognize the identification broadcast message without the need to decode the message in its entirety, the processor being a System on Chip which can only send, forward and receive alerts to and from one or more remote devices.

2. The apparatus for detecting drones of claim 1 wherein the System on Chip is both the processor and memory.

3. The apparatus for detecting drones of claim 1 further including a connector.

4. The apparatus for detecting drones of claim 1 wherein the radio has WiFi® and Bluetooth® capabilities.

5. The apparatus for detecting drones of claim 1 wherein once the processor has recognized the remote identification message the at least one indicator can alert a user as to the presence of a drone.

6. The apparatus for detecting drones of claim 1 the housing-carrier can be attached to, hung on or mounted to an object or the housing-carrier can incorporated into a watch, jewelry, USB dongle or a compass.

7. The apparatus for detecting drones of claim 1 wherein the at least one indicator can be a visual indicator including one or more lights or can be an audible indicator including a tone, chirp or other sound.

8. The apparatus for detecting drones of claim 7 wherein the visual indicator can be one or more lights in various colors or can be a flashing light with a rate proportional to receive signal strength indication from the drone.

9. The apparatus for detecting drones of claim 8 wherein the visual indicator or the audible indicator turns on to indicate receiving a remote identification message from a drone and turns off after a selected time period when the remote identification message is no longer received, both the visual indicator and the audible indicator are able to adjusted.

10. The apparatus for detecting drones of claim 7 wherein the audible indicator can be one or more sounds with a rate proportional to receive signal strength indication from the drone, the audible indicator having a mute switch.

11. The apparatus for detecting drones of claim 7 wherein the visual indicator is an LED with a translucent lens.

12. The apparatus for detecting drones of claim 2 wherein the memory can record and store remote identification messages from a drone for future reference by a user.

13. A method for detecting and alerting a user to the presence of a drone, said method comprising:

providing a housing having a processor, the processor being a System on Chip with a simple message filter, at least one indicator, at least one switch, a connector, a radio, an antenna and a power source; and a housing-carrier in which the housing is removably secured;

receiving and recognizing a remote identification message wherein the simple message filter need not decode the remote identification message in its entirety, transmitted from a drone through the System on Chip which can then only send, forward and receive alerts to and from one or more remote devices; and alerting a user to the presence of a drone by turning on the at least one indicator, the at least one indicator being visual, audible or a vibration.

14. The method according to claim 13 wherein the processor receives and recognizes the remote identification message and the at least one indicator can alert a user as to the presence of a drone.

15. The method according to claim 13 further including the at least one indicator turns on to indicate receiving a remote identification message from a drone and turns off after a selected time period when the remote identification message is no longer received.

16. An apparatus for detecting drones comprising:

a housing having a System on Chip including a processor with a simple message filter and memory, at least one indicator, at least one switch, a connector, a radio, an antenna and a power source; and a housing-carrier in which the housing is removably secured, wherein when a drone transmits an identification broadcast message the System on Chip can receive and recognize a remote identification message wherein the simple message filter need not decode the remote identification message in its entirety, intermittently broadcast from a drone and can only send, forward and receive alerts to and from one or more remote devices.

* * * * *